US011583717B1

(12) United States Patent
Zhu

(10) Patent No.: US 11,583,717 B1
(45) Date of Patent: Feb. 21, 2023

(54) TRAMPOLINE

(71) Applicant: Guoyi Zhu, Taishan (CN)

(72) Inventor: Guoyi Zhu, Taishan (CN)

( * ) Notice: Subject to any disclaimer, the term of this patent is extended or adjusted under 35 U.S.C. 154(b) by 0 days.

(21) Appl. No.: 17/485,523

(22) Filed: Sep. 27, 2021

(30) Foreign Application Priority Data

Sep. 9, 2021 (CN) ..... 202122173082.8

(51) Int. Cl.
*A63B 5/11* (2006.01)
*A63B 21/02* (2006.01)
*A63B 71/02* (2006.01)

(52) U.S. Cl.
CPC ..... *A63B 5/11* (2013.01); *A63B 21/023* (2013.01); *A63B 71/022* (2013.01)

(58) Field of Classification Search
CPC ..... A63B 5/11; A63B 5/08; A63B 21/00047; A63B 21/023; A63B 21/025; A63B 71/022
See application file for complete search history.

(56) References Cited

U.S. PATENT DOCUMENTS 4,863,156 A * 9/1989 Shaw ..... A63B 5/11 482/27
5,275,578 A * 1/1994 Adams ..... A63B 5/11 606/151
7,927,254 B2 * 4/2011 Adams ..... A63B 5/11 482/28
7,929,254 B2 * 4/2011 Soga ..... G11B 5/4833 360/266
2020/0094094 A1 * 3/2020 Zhu ..... A63B 5/11
2020/0282253 A1 * 9/2020 Publicover ..... A63B 5/11
2020/0338379 A1 * 10/2020 Chen ..... A63B 5/11
2021/0299970 A1 * 9/2021 Chu ..... B29C 66/84

* cited by examiner

*Primary Examiner* — Jennifer Robertson
*Assistant Examiner* — Jacqueline N L Loberiza
(74) *Attorney, Agent, or Firm* — Bayramoglu Law Offices LLC

(57) ABSTRACT

A trampoline includes a bounce fabric, a plurality of fabric clamps and a fixed frame. The bounce fabric is connected to the fabric clamps, and one end of the fabric clamp is connected to one end of a spring. The fixed frame includes connectors and frame grooved pipes. The surface of the frame grooved pipe is provided with a grooved-pipe horizontal channel, and the other end of the spring is connected to the grooved-pipe horizontal channel on the surface of the frame grooved pipe. The connector is provided with a grooved-pipe connecting end and a support-pipe connecting end. The inner side of the grooved-pipe connecting end is provided with a through hole, and the surface of the grooved-pipe connecting end is provided with a groove. One end of the frame grooved pipe is arranged in the through hole. The groove is arranged in the grooved-pipe horizontal channel.

8 Claims, 15 Drawing Sheets

TRAMPOLINE

CROSS REFERENCE TO THE RELATED APPLICATIONS

This application is based upon and claims priority to Chinese Patent Application No. 202122173082.8, filed on Sep. 9, 2021 the entire contents of which are incorporated herein by reference.

TECHNICAL FIELD

The present invention relates to the technical field of trampolines, and in particular to a trampoline.

BACKGROUND

A trampoline is mainly composed of a bounce fabric and a fixed frame. Users can bounce on the surface of the bounce fabric to perform various movements, which can help prevent or reduce obesity. As a workout that burns more calories than jogging and other ordinary exercises, trampoline exercise is conducive to boosting metabolism, increasing fat oxidation, and preventing and reducing obesity. In a traditional trampoline, the bounce fabric and the fixed frame are connected by woven strips. With this traditional connection mode, however, the trampoline has a relatively low pressure-bearing capacity and thus is easily damaged when heavier users are bouncing on it. Moreover, as one major disadvantage of the traditional trampoline, the traditional connection mode (woven strips) provides insufficient elasticity, which limits the height that users can bounce to during the use of the trampoline.

SUMMARY

In order to solve the above-mentioned problems, the present invention provides a trampoline, where the bounce fabric is connected to one end of a bounce fabric clamp, the other end of the fabric clamp is connected to one end of a spring, and the other end of the spring is connected to a fixed frame. The trampoline has a simple structure, is convenient to use, has better stability, and is safer and more durable.

In order to achieve the above-mentioned objective, the present invention adopts the following technical solution. A trampoline includes a bounce fabric, a plurality of fabric clamps, and a fixed frame. The bounce fabric is connected to the fabric clamps. One end of the fabric clamp is connected to one end of a spring. The fixed frame includes connectors and frame grooved pipes. The surface of the frame grooved pipe is provided with a grooved-pipe horizontal channel. The other end of the spring is connected to the grooved-pipe horizontal channel on the surface of the frame grooved pipe. The connector is provided with a grooved-pipe connecting end and a support-pipe connecting end. The inner side of the grooved-pipe connecting end is provided with a through hole. The surface of the grooved-pipe connecting end is provided with a groove. One end of the frame grooved pipe is arranged in the through hole, and the groove is arranged in the grooved-pipe horizontal channel.

Further, the fabric clamp includes a fabric-clamp upper plate and a fabric-clamp lower plate. The fabric-clamp upper plate includes an upper-plate welding surface and an upper-plate protrusion. The surface of the upper-plate protrusion is provided with a plurality of protruding locating pins. The fabric-clamp lower plate includes a lower-plate welding surface and a lower-plate groove. A plurality of lower-plate locating holes are arranged in the lower-plate groove. The bounce fabric is arranged between the lower-plate welding surface and the upper-plate welding surface. The upper-plate protrusion is arranged in the lower-plate groove, and the protruding locating pins are arranged in the lower-plate locating holes.

Further, the fixed frame includes trampoline support pipes. The top end of the trampoline support pipe is provided with a connector slot. The connector is provided with a support-pipe connecting end. The support-pipe connecting end is provided with snap-fit male and female sockets, and the snap-fit male and female sockets are arranged in the connector slot.

Further, the trampoline support pipe includes a protective net support pipe. The other end of the trampoline support pipe is provided with a support-pipe fixing base. The support-pipe fixing base is provided with a rod body and a plurality of connecting pieces. The plurality of connecting pieces are arranged on the surface of the rod body, and the connecting pieces are connected to the surface of the trampoline support pipe.

Further, the rod body is a square structure.

Further, the fabric-clamp upper plate is provided with an upper-plate groove, and the upper-plate groove is provided with a plurality of back-baffle locating holes. The fabric clamp includes a fabric-clamp back baffle, and the fabric-clamp back baffle is provided with a back-baffle protrusion. A plurality of back-baffle locating pins are arranged on the surface of the back-baffle protrusion. The back-baffle protrusion is arranged in the upper-plate groove, and the back-baffle locating pins are arranged in the back-baffle locating holes.

Further, the fabric-clamp back baffle is provided with a baffle, and the baffle is provided with a plurality of reinforcing ribs.

Further, the surface of the baffle is provided with a plurality of exhaust holes.

Further, the fabric-clamp upper plate is fixedly fused to the fabric-clamp lower plate and the bounce fabric by ultrasonic welding.

The advantages of the present invention are as follows. In the present invention, one end of the fabric clamp is connected to the bounce fabric, the other end of the fabric clamp is connected to one end of the spring, and the other end of the spring is connected to the fixed frame. With this connecting structure, the trampoline enhances the pressure-bearing strength of the frame grooved pipes, and thus has better stability, is safer and more durable.

DETAILED DESCRIPTION OF THE EMBODIMENTS

Figure 1:
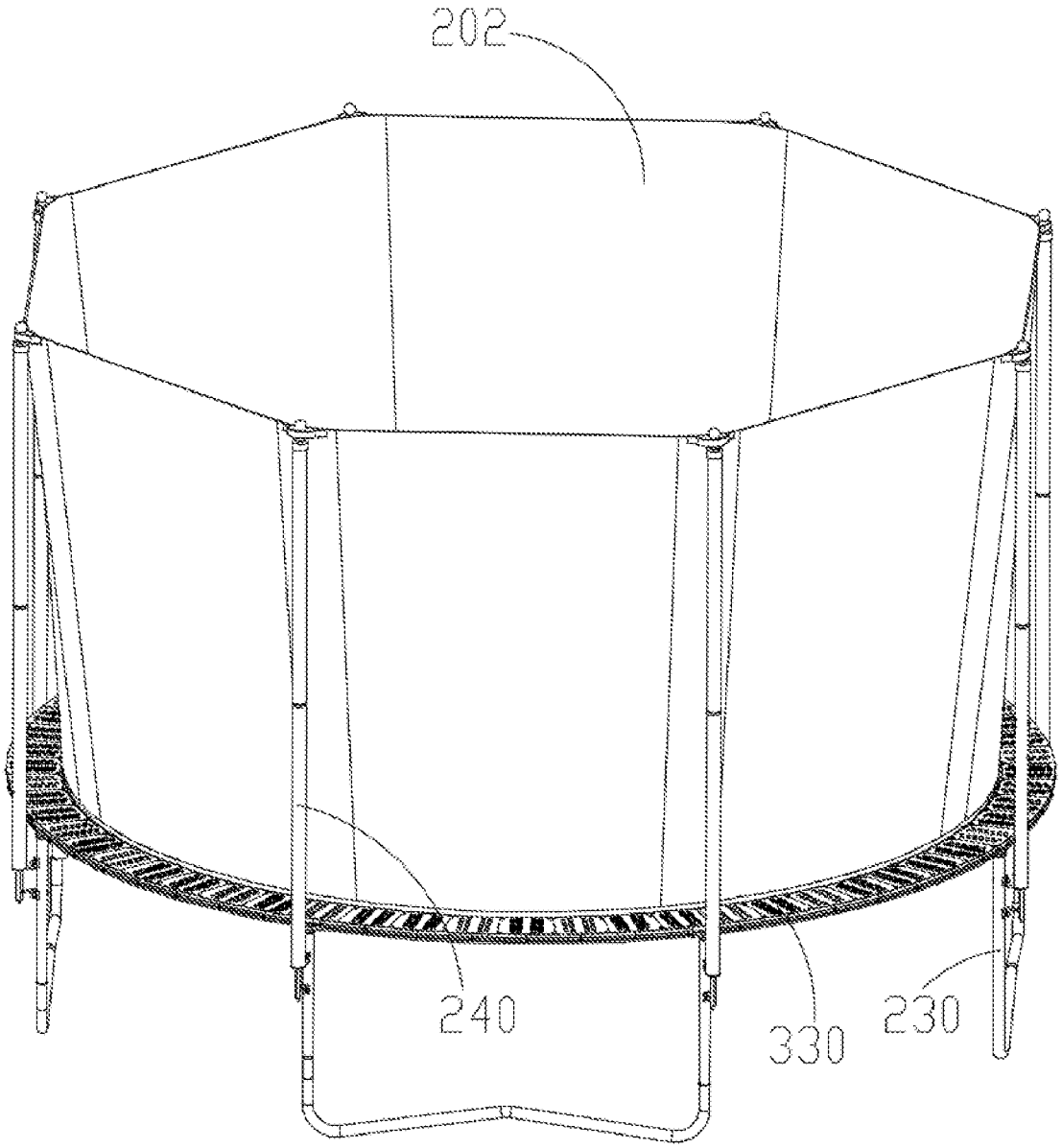
FIG. 1 is a schematic diagram of the overall structure of the trampoline of the present invention.
Figure 2:
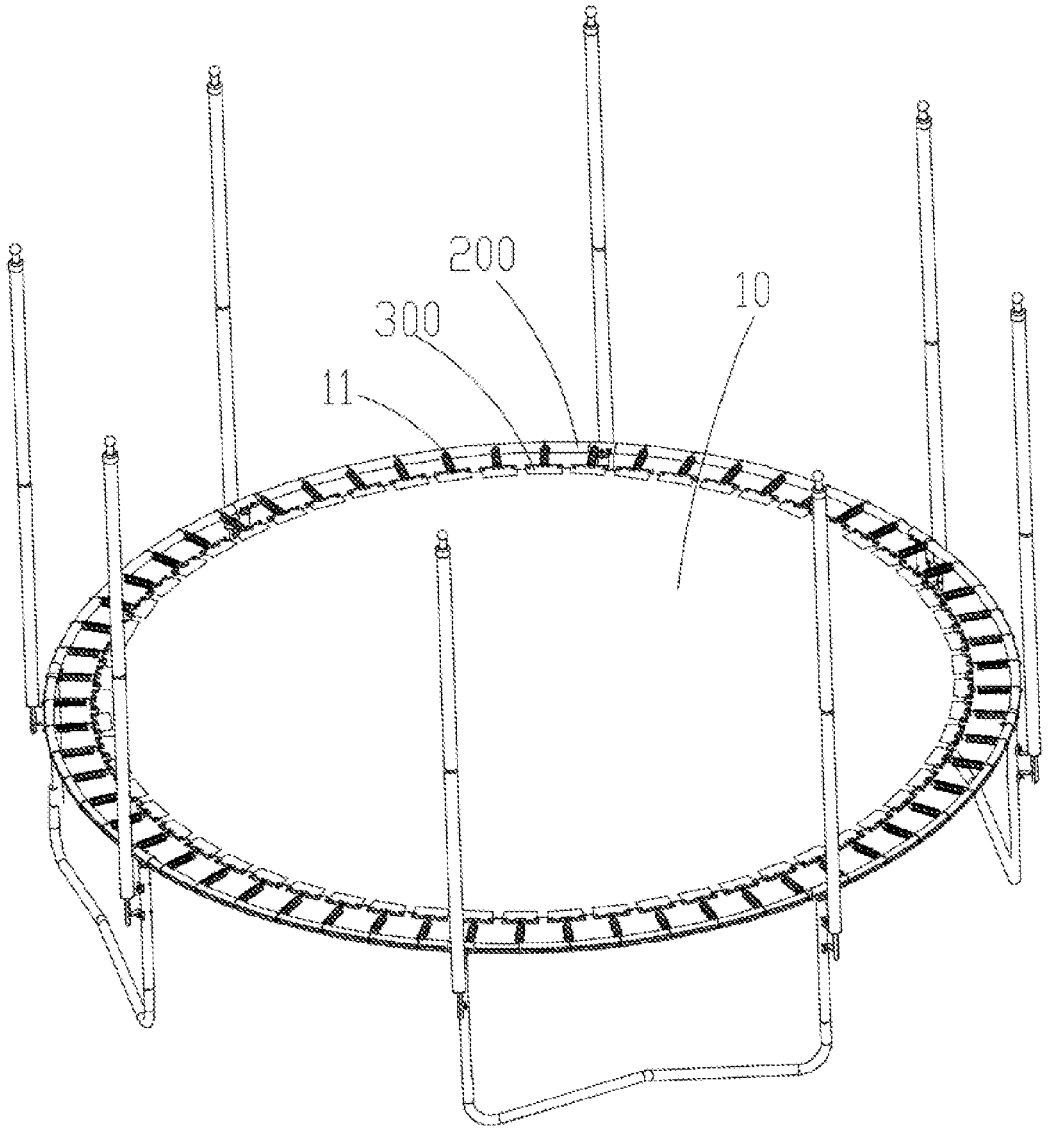
FIG. 2 is a structural schematic diagram of the connection between the bounce fabric, the fabric clamps, and the fixed frame of the present invention.
Figure 3:
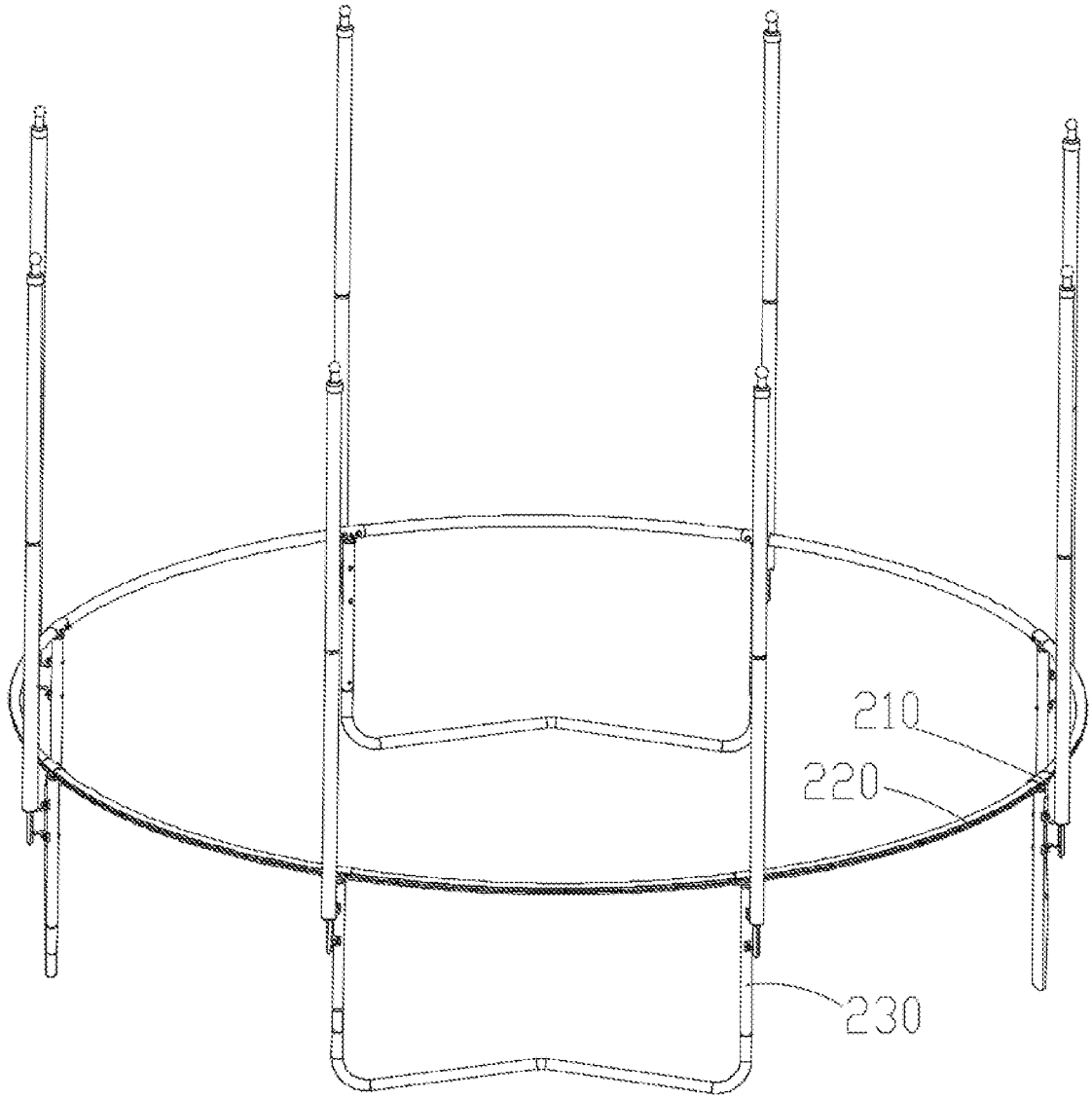
FIG. 3 is a structural schematic diagram of the fixed frame of the present invention.
Figure 4:
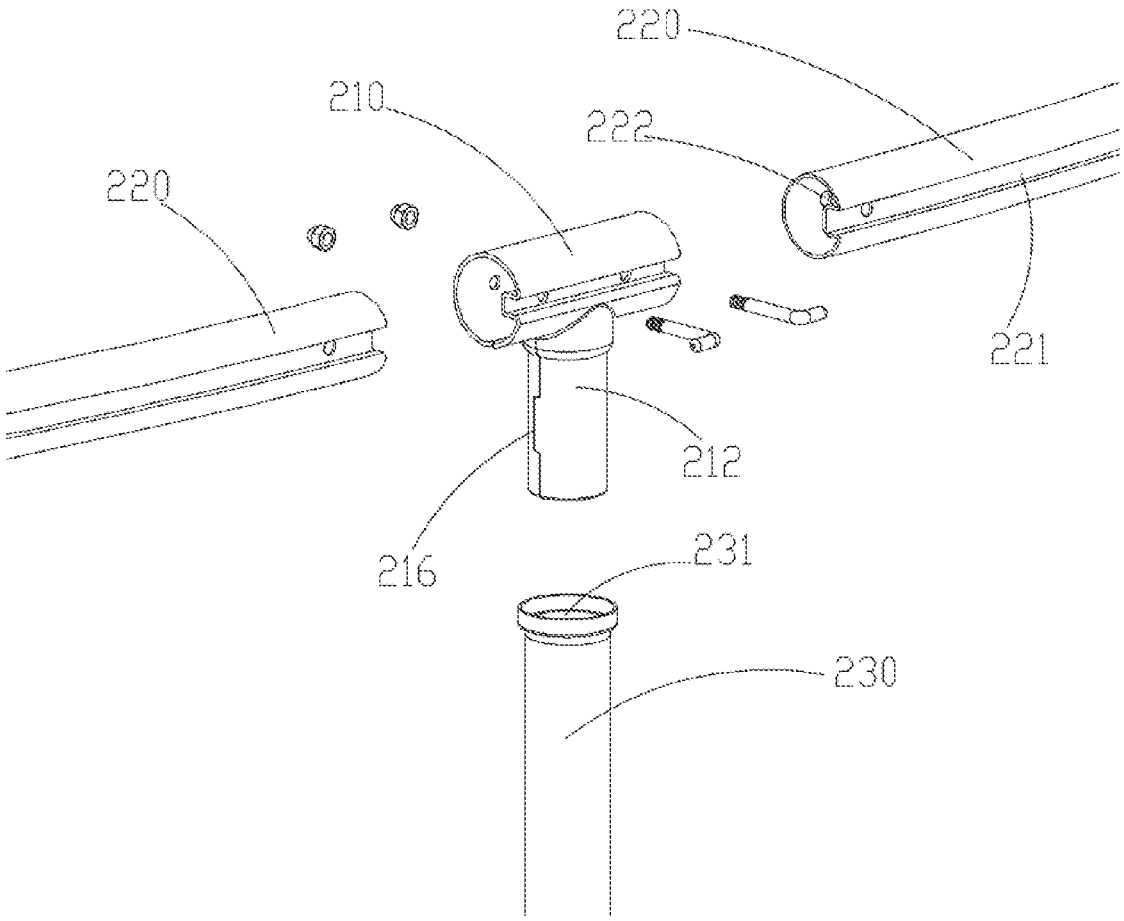
FIG. 4 is a partial exploded view of the connector, the frame grooved pipe and the trampoline support pipe of the present invention.
Figure 5:
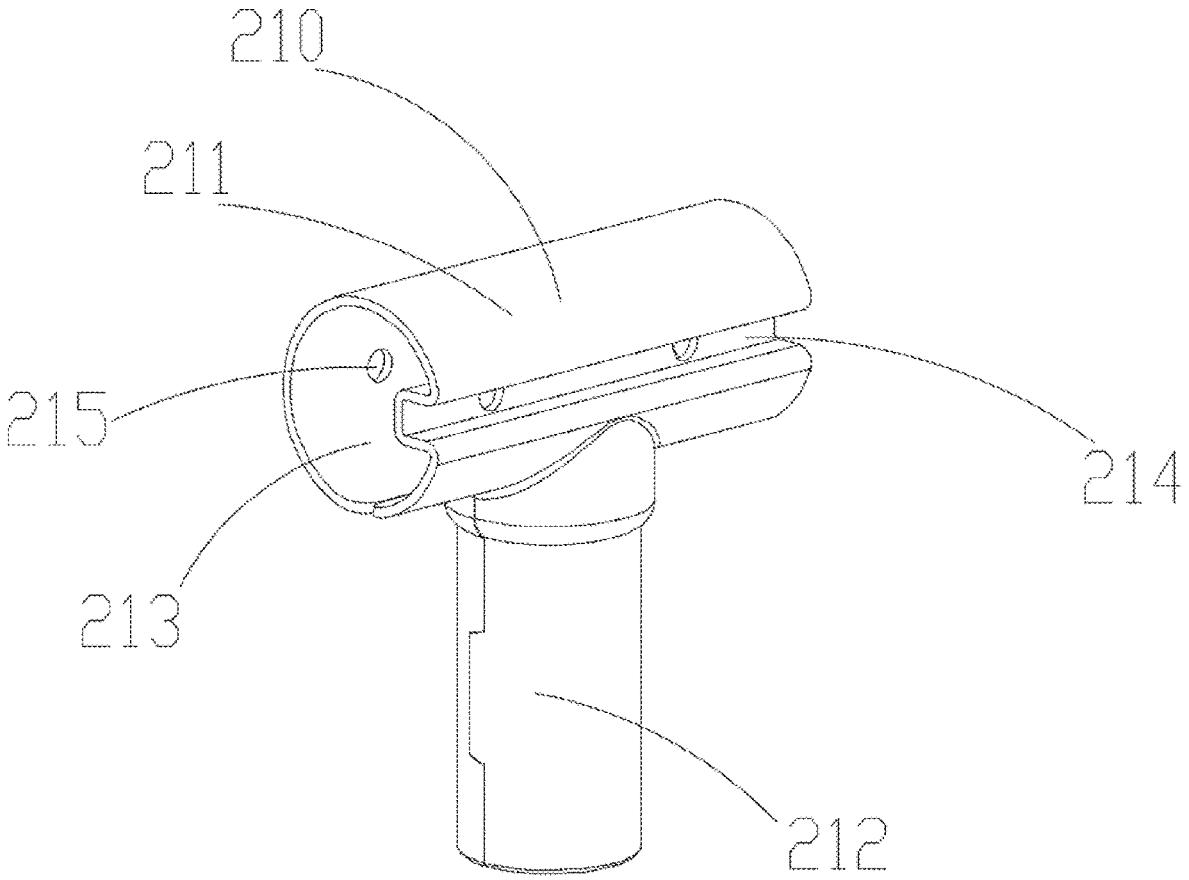
FIG. 5 is a structural schematic diagram of the connector of the present invention.
Figure 6:
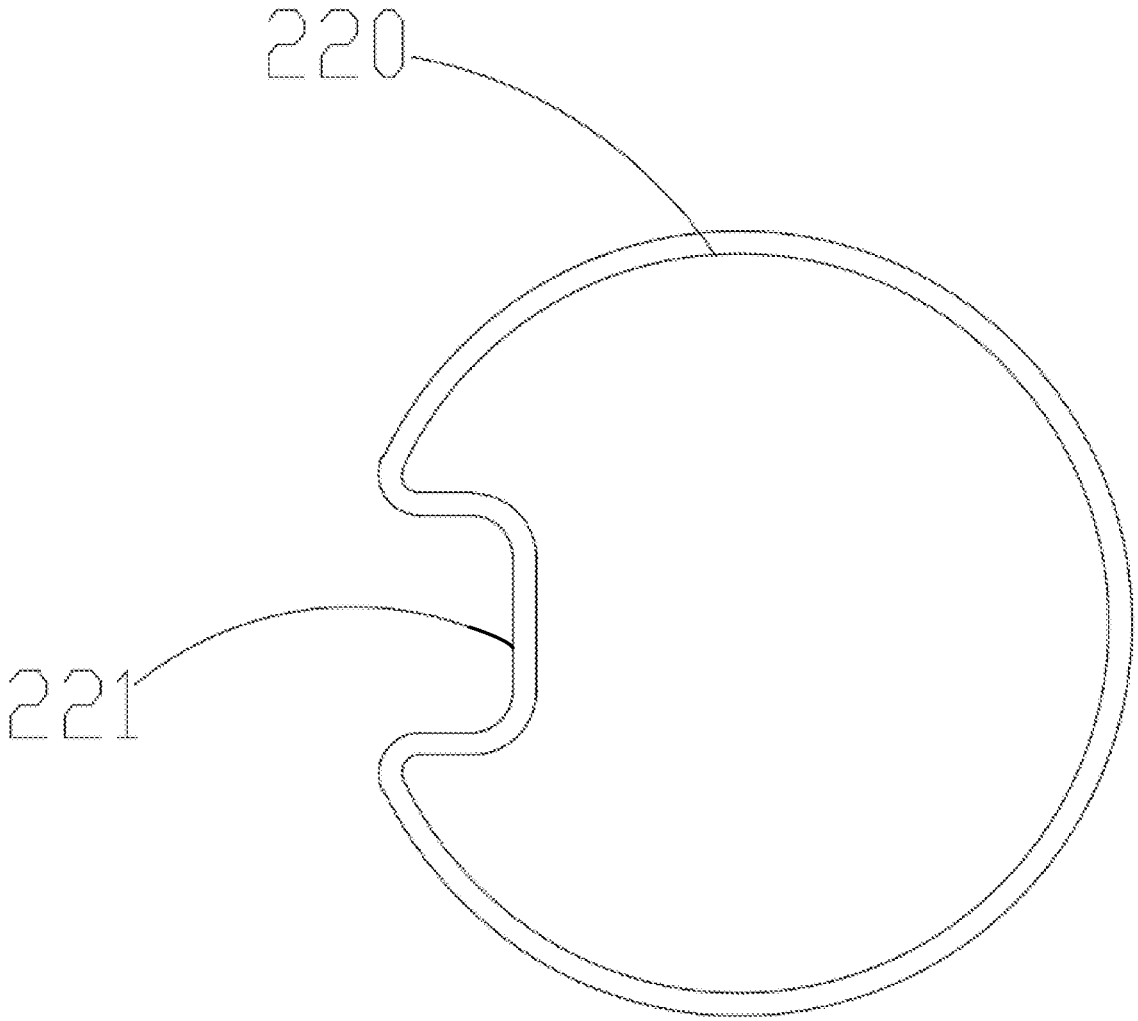
FIG. 6 is a structural schematic diagram of the cross-section of the frame grooved pipe of the present invention.
Figure 7:
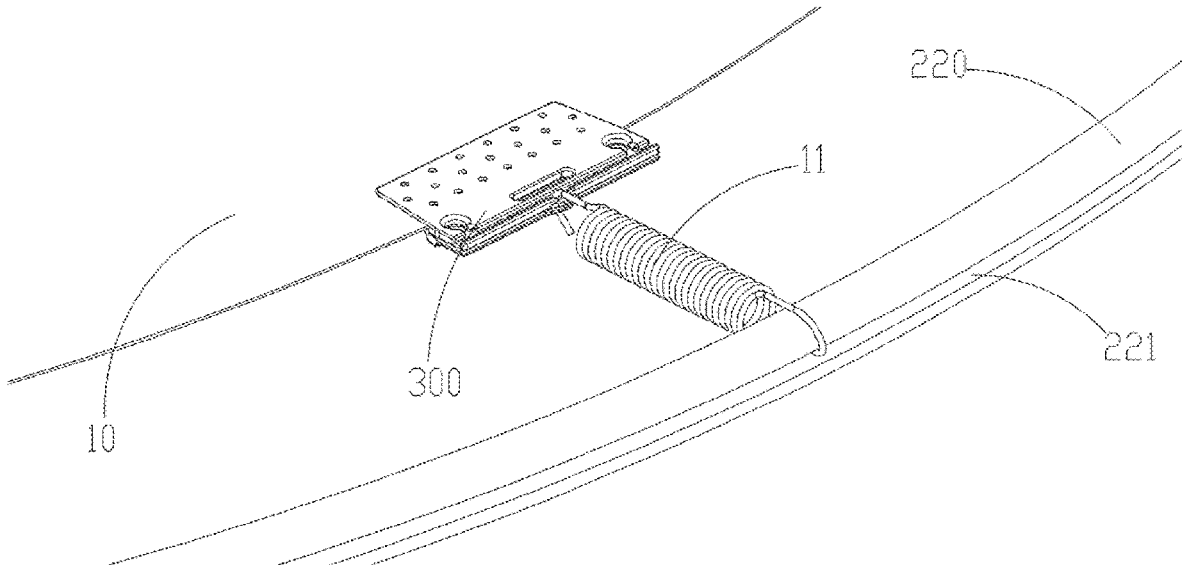
FIG. 7 is a schematic diagram of the connection between the spring and the frame grooved pipe of the present invention.
Figure 8:
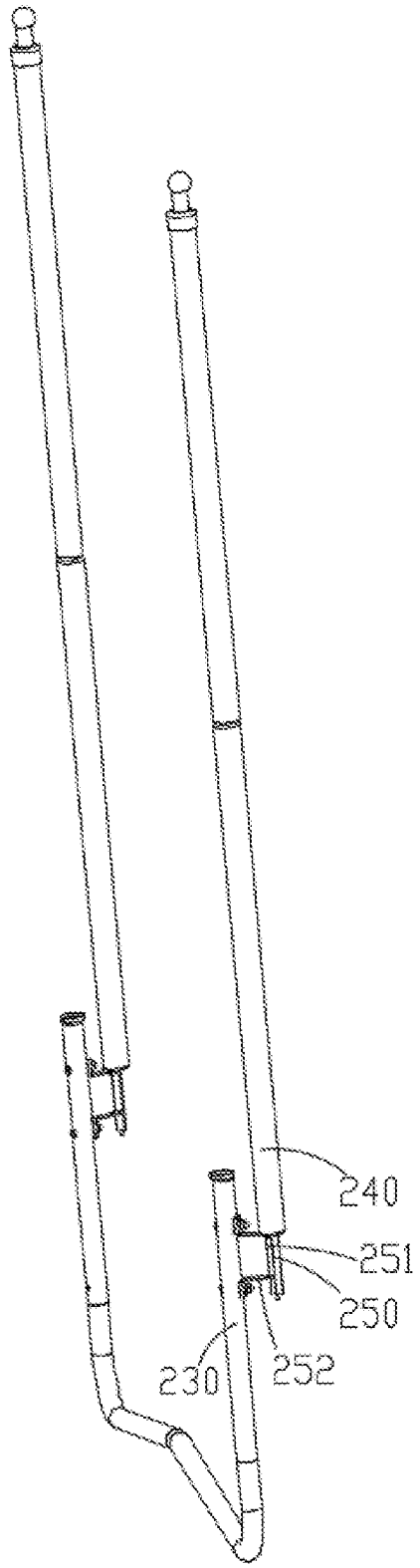
FIG. 8 is a structural schematic diagram of the trampoline support pipe and the protective net support pipe of the present invention.
Figure 9:
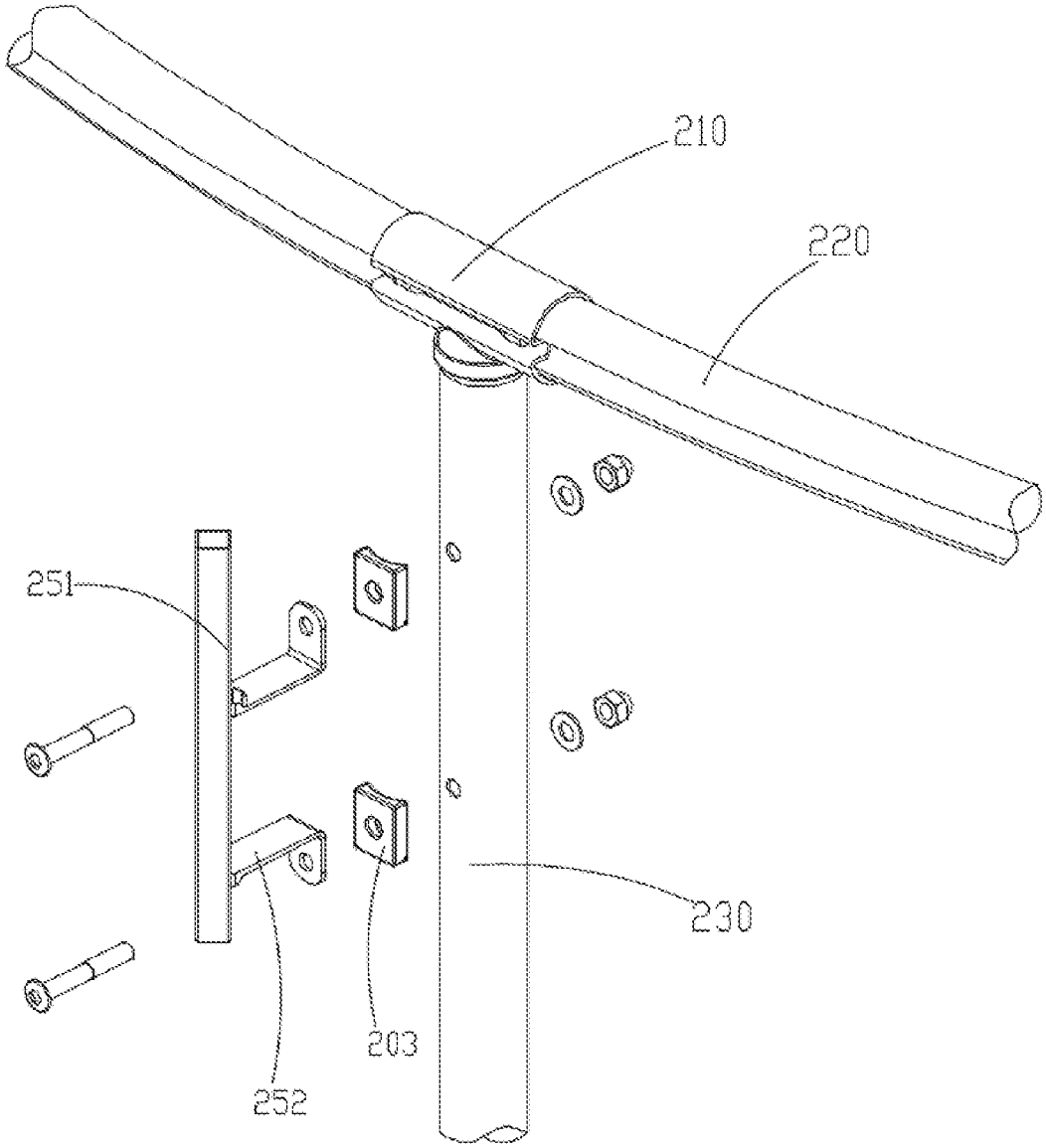
FIG. 9 is an exploded view of the trampoline support pipe and the support-pipe fixing base of the present invention.
Figure 10:
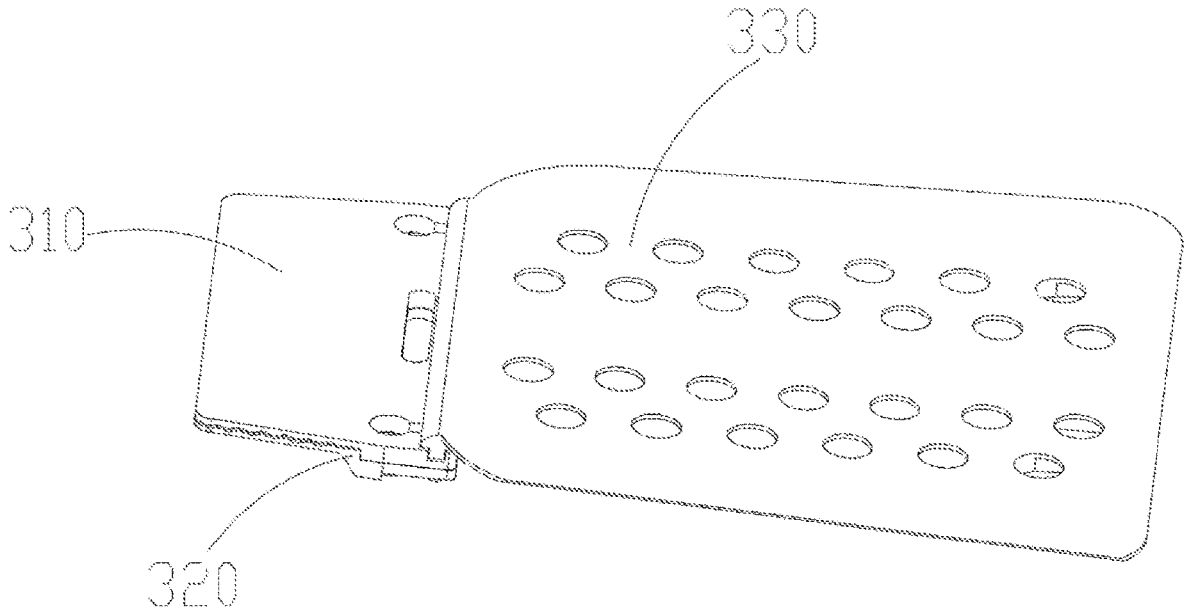
FIG. 10 is a schematic diagram of the overall structure of the fabric clamp of the present invention.
Figure 11:
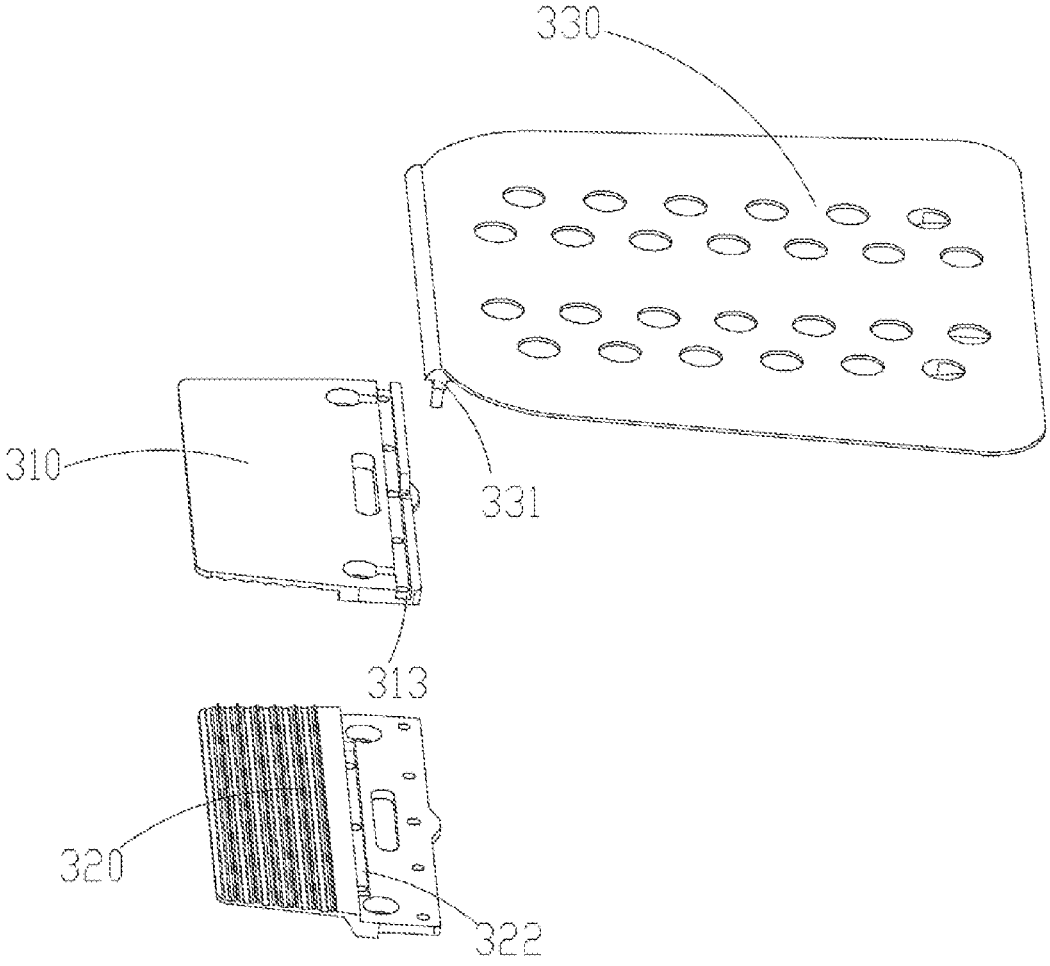
FIG. 11 is an exploded view of the fabric clamp of the present invention.
Figure 12:
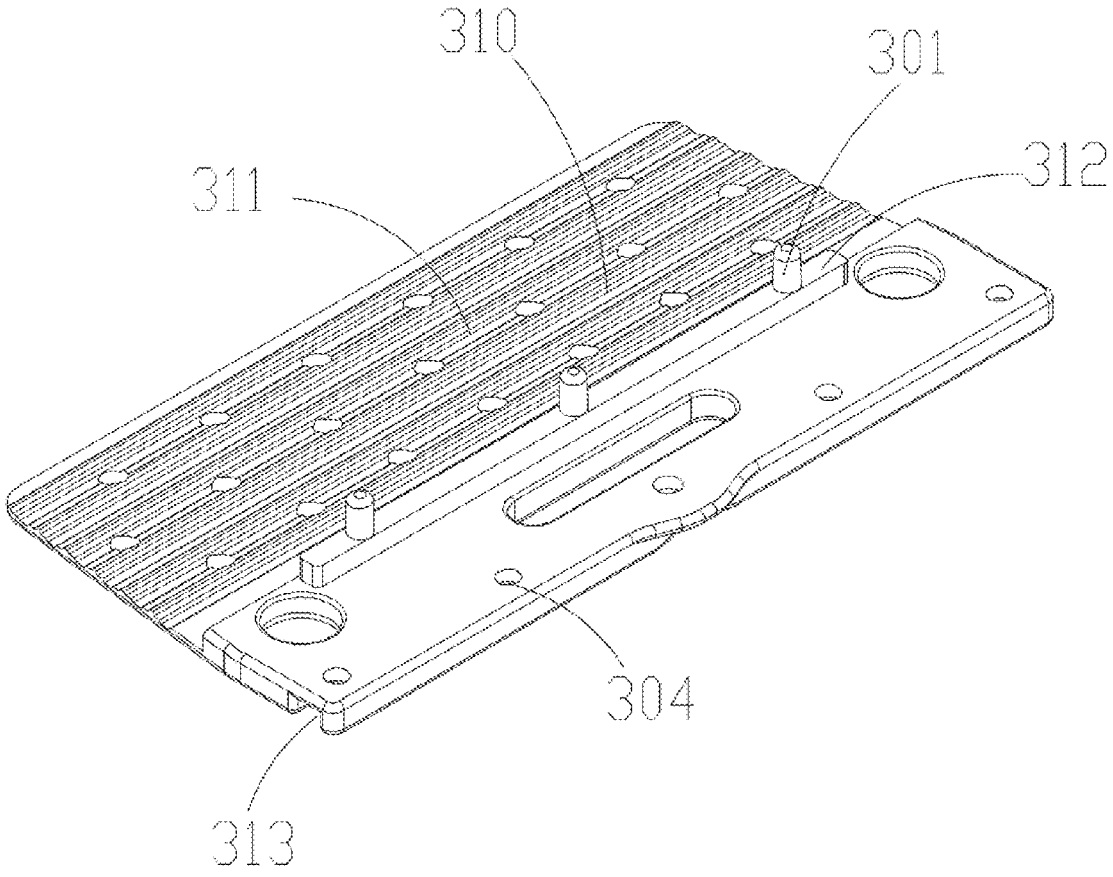
FIG. 12 is a structural schematic diagram of the fabric-clamp upper plate of the present invention.
Figure 13:
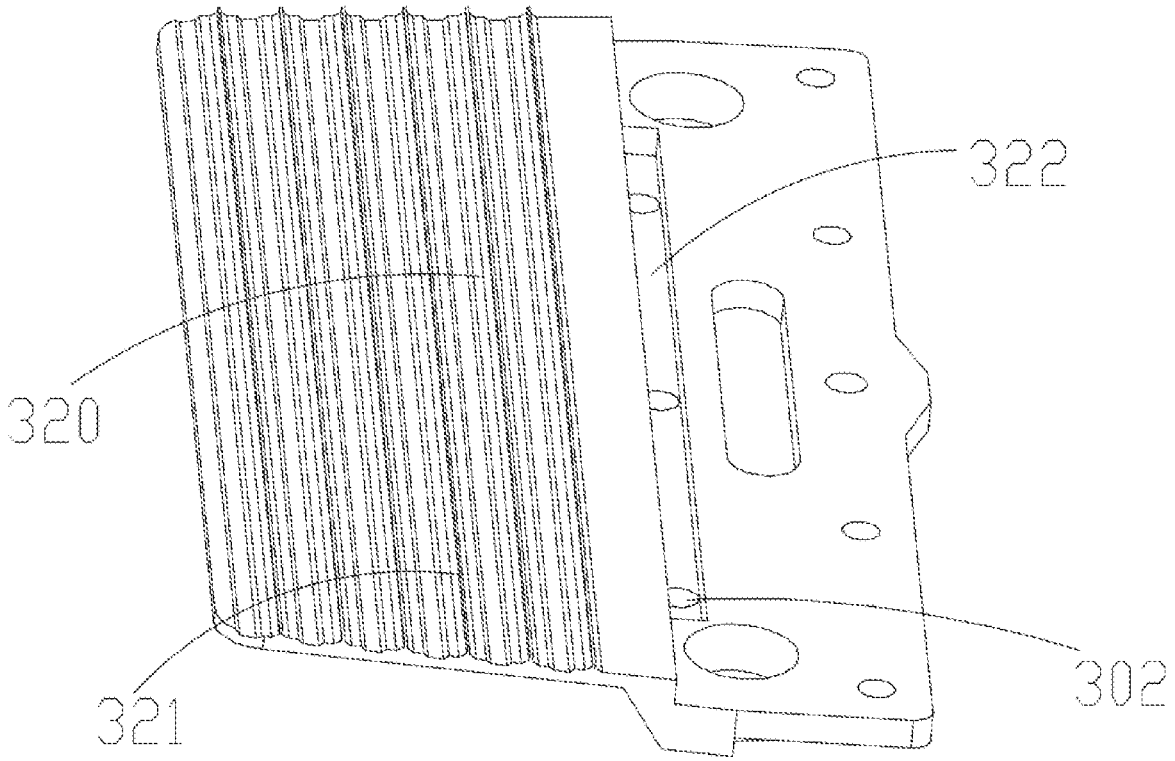
FIG. 13 is a structural schematic diagram of the fabric-clamp lower plate of the present invention.
Figure 14:
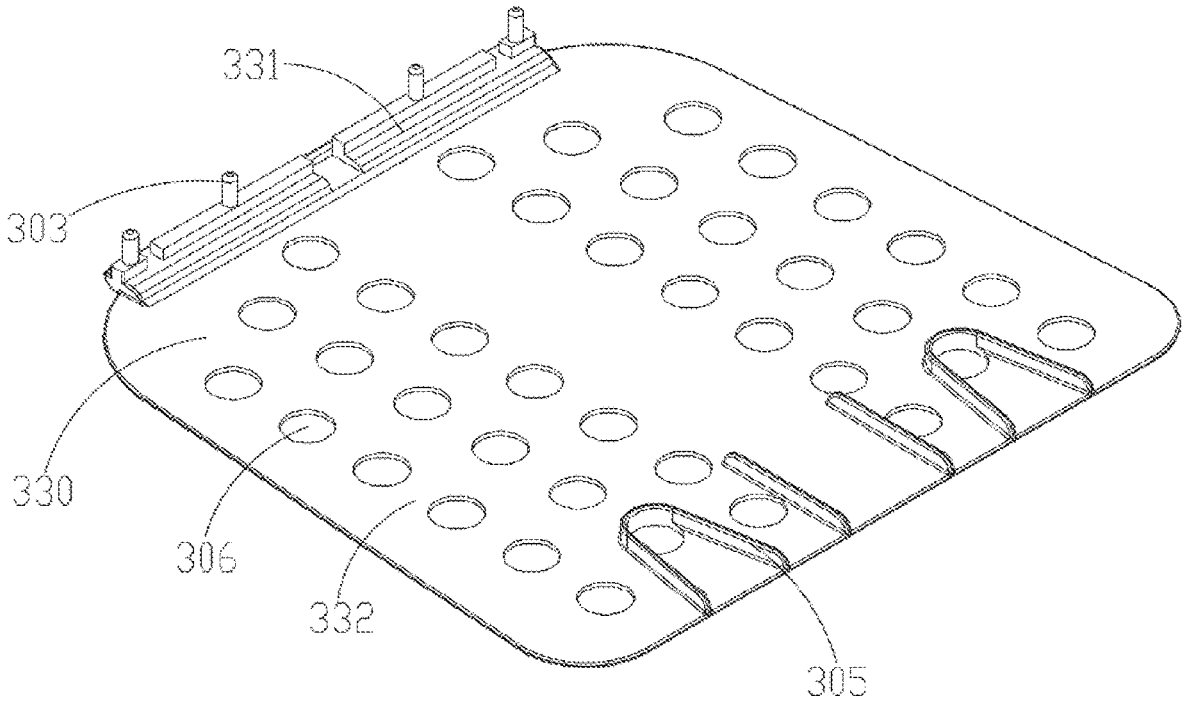
FIG. 14 is a structural schematic diagram of the fabric-clamp back baffle of the present invention.
Figure 15:
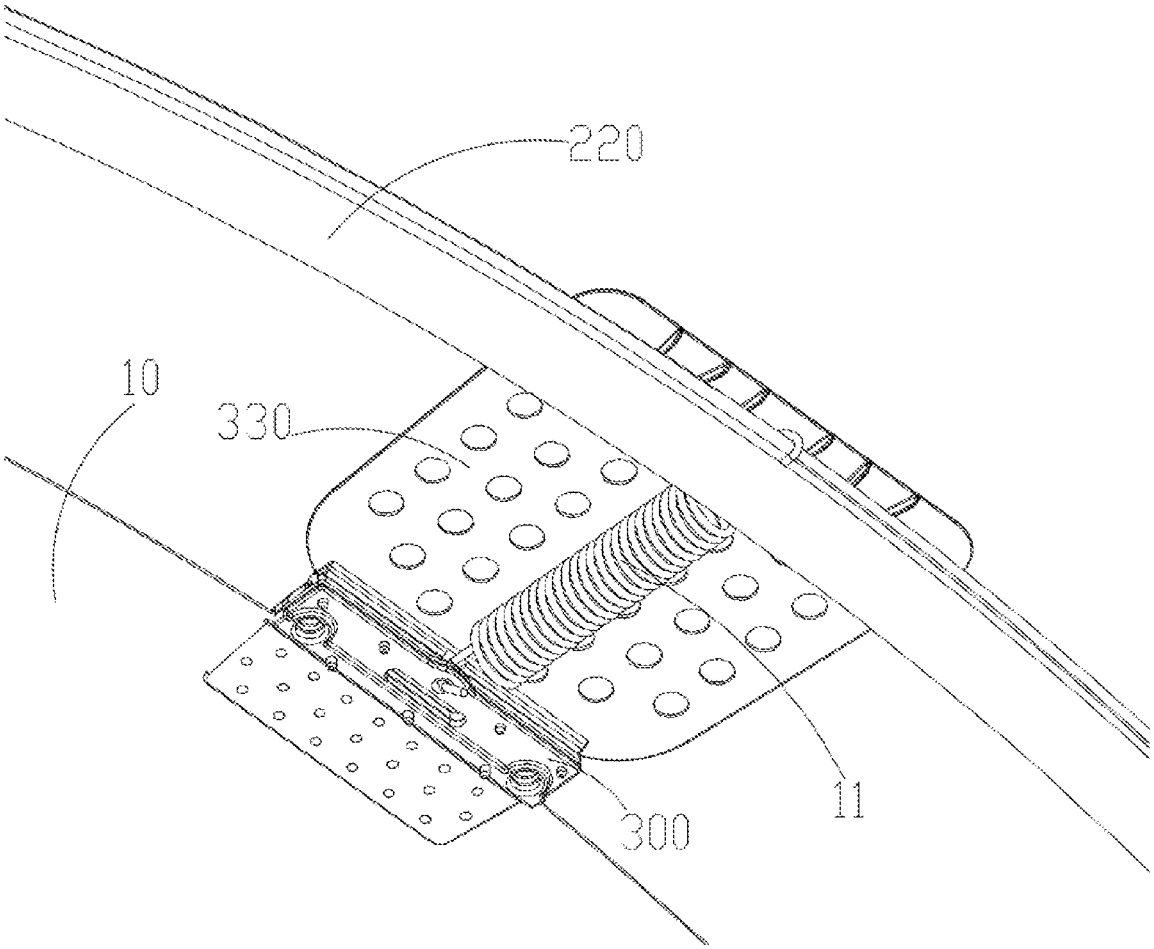
FIG. 15 is a schematic diagram of the connection between the fabric clamp, the spring, and the fixed frame of the present invention.

As shown in FIGS. 1 to 15, the trampoline includes the bounce fabric 10, a plurality of the fabric clamps 300 and the fixed frame 200. The bounce fabric 10 is connected to the fabric clamps 300. One end of the fabric clamp 300 is ultrasonically welded on the edge of the bounce fabric 10, and the other end of the fabric clamp 300 is connected to the fixed frame 200 through the spring 11.

In practical implementation, the bottom end of the fixed frame 200 is in contact with the ground, and the top end of the fixed frame 200 is connected to the bounce fabric 10 through the fabric clamps 300, so that users can bounce on the upper surface of the bounce fabric 10.

The fabric clamp 300 is provided with a spring fixing hole, and one end of the spring 11 is connected inside the spring fixing hole.

The fixed frame 200 includes the connectors 210, the frame grooved pipes 220 and the trampoline support pipes 230. The surface of the frame grooved pipe 220 is provided with the grooved-pipe horizontal channel 221 and a plurality of the fixed holes 222.

The other end of the spring 11 is connected to the grooved-pipe horizontal channel 221 on the surface of the frame grooved pipe 220. The grooved-pipe horizontal channel 221 can not only connect the spring 11, but also enhance the pressure-bearing strength of the frame grooved pipe 220.

The connector 210 is provided with the grooved-pipe connecting end 211 and the support-pipe connecting end 212. The inner side of the grooved-pipe connecting end 211 is provided with the through hole 213, and the surface of the grooved-pipe connecting end 211 is provided with the groove 214 and a plurality of the second fixed holes 215.

When the frame grooved pipe 220 is connected to the connector 210, one end of the frame grooved pipe 220 is arranged in the through hole 213 of the connector 210, and the groove 214 is arranged in the grooved-pipe horizontal channel 221. The fixed holes 222 and the second fixed holes 215 are fixedly connected by an L-shaped screw rod.

The support-pipe connecting end 212 is provided with the snap-fit male and female sockets 216.

The top end of the trampoline support pipe 230 is provided with the connector slot 231, and the snap-fit male and female sockets are arranged in the connector slot 231.

The surface of the trampoline support pipe 230 is provided with a plurality of connecting holes.

The trampoline support pipe 230 includes the protective net support pipe 240, and one end of the protective net support pipe 240 is connected to the protective net 202, which prevents users from falling off the trampoline during use, thereby avoiding injuries.

The other end of the protective net support pipe 240 is provided with the support-pipe fixing base 250. The support-pipe fixing base 250 is provided with the rod body 251 and a plurality of the connecting pieces 252. A plurality of connecting pieces 252 are arranged on the surface of the rod body 251. The connecting pieces 252 are connected to the connecting holes on the surface of the trampoline support pipe 230 through screws.

The rod body 251 is configured as a square structure. At present, a rod body on the market is typically made of an annular pipe. In the present invention, square pipes are used instead to improve the support strength of the protective net 202 by using the strength of the four corners of the square pipes. In this configuration, the square pipes applied to the protective net 202 can further improve the service life of the protective net 202 while satisfying quality requirements.

The spacer blocks 203 are arranged between the connecting pieces 252 and the trampoline support pipe 230.

The fabric clamp 300 includes the fabric-clamp upper plate 310 and the fabric-clamp lower plate 320. The fabric-clamp upper plate 310 includes the upper-plate welding surface 311, the upper-plate protrusion 312 and the upper-plate groove 313. The upper-plate protrusion 312 is provided with a plurality of the protruding locating pins 301.

The fabric-clamp lower plate 320 includes the lower-plate welding surface 321 and the lower-plate groove 322, and the lower-plate groove 322 is provided with a plurality of the lower-plate locating holes 302.

The lower-plate welding surface 321 is connected to the upper-plate welding surface 311. Between the lower-plate welding surface 321, the upper-plate welding surface 311, and the bounce fabric 10, the fabric-clamp upper plate 310 is fixedly fused to the fabric-clamp lower plate 320 and the bounce fabric 10 by ultrasonic welding.

The upper-plate protrusion 312 is arranged in the lower-plate groove 322, and the protruding locating pins 301 are arranged in the lower-plate locating holes 302 to connect the fabric-clamp upper plate 310 and the fabric-clamp lower plate 320.

The fabric clamp 300 further includes the fabric-clamp back baffle 330, and the fabric-clamp back baffle 330 has the back-baffle protrusion 331 and the baffle 332. The back-baffle protrusion 331 is arranged at one end of the baffle 332.

The surface of the back-baffle protrusion 331 is provided with a plurality of the back-baffle locating pins 303.

In practical implementation, the back-baffle protrusion 331 is arranged in the upper-plate groove 313, the upper-plate groove 313 is provided with a plurality of the back-baffle locating holes 304, and the back-baffle locating pins 303 are arranged in the back-baffle locating holes 304.

The other end of the baffle 332 is provided with a plurality of the reinforcing ribs 305 to increase the stability of the fabric-clamp back baffle 330.

The surface of the fabric-clamp back baffle 330 is provided with a plurality of the exhaust holes 306.

In use, one end of the fabric clamp 300 is connected to the bounce fabric 10, the other end of the fabric clamp 300 is connected to one end of the spring 11, and the other end of the spring 11 is connected to the fixed frame 200. With this connecting structure, the trampoline enhances the pressure-bearing strength of the frame grooved pipes 220, and thus has better stability, is safer and more durable.

The invention claimed is:

1. A trampoline, comprising a bounce fabric, a plurality of fabric clamps and a fixed frame, wherein the bounce fabric is connected to the plurality of fabric clamps, an end of each of the plurality of fabric clamps is connected to a first end of a spring, the fixed frame comprises connectors and frame grooved pipes, a surface of each of the frame grooved pipes is provided with a grooved-pipe horizontal channel, a second end of the spring is connected to the grooved-pipe horizontal channel on the surface of the each of the frame grooved pipes, each of the connectors is provided with a grooved-pipe connecting end, an inner side of the grooved-pipe connecting end is provided with a through hole, a surface of the grooved-pipe connecting end is provided with a groove, an end of the each of the frame grooved pipes is arranged in the through hole, and the groove is arranged in the grooved-pipe horizontal channel;

wherein the each of the plurality of fabric clamps comprises a fabric-clamp upper plate and a fabric-clamp lower plate, the fabric-clamp upper plate comprises an upper-plate welding surface and an upper-plate protrusion, a surface of the upper-plate protrusion is provided with a plurality of protruding locating pins, the fabric-clamp lower plate comprises a lower-plate welding surface and a lower-plate groove, the lower-plate groove is inside provided with a plurality of lower-plate locating holes, the bounce fabric is arranged between the lower-plate welding surface and the upper-plate welding surface, the upper-plate protrusion is arranged in the lower-plate groove, and each of the plurality of protruding locating pins is arranged into a corresponding hole of the plurality of lower-plate locating holes;

wherein the fabric-clamp upper plate is provided with an upper-plate groove, and the upper-plate groove is provided with a plurality of back-baffle locating holes, each of the plurality of fabric clamps further comprises a fabric-clamp back baffle, and the fabric-clamp back baffle is provided with a back-baffle protrusion, a surface of the back-baffle protrusion of the fabric-clamp back baffle is provided with a plurality of back-baffle locating pins, the back-baffle protrusion of the fabric-clamp back baffle is arranged in the upper-plate groove, and the plurality of back-baffle locating pins are arranged in the plurality of back-baffle locating holes.

2. The trampoline according to claim 1, wherein the fixed frame further comprises trampoline support pipes, and a top end of each of the trampoline support pipes is provided with a connector slot.

3. The trampoline according to claim 2, wherein the each of the trampoline support pipes further comprises a protective net support pipe, and an end of the protective net support pipe is provided with a support-pipe fixing base, the support-pipe fixing base is provided with a rod body and a plurality of connecting pieces; the plurality of connecting pieces are arranged on a surface of the rod body, and each of the plurality of connecting pieces is connected to a surface of the each of the trampoline support pipes.

4. The trampoline according to claim 3, wherein the rod body is a square structure.

5. The trampoline according to claim 3, further comprising a plurality of spacer blocks, wherein each of the spacer blocks is arranged between the each of the plurality of the connecting pieces and the each of the trampoline support pipes.

6. The trampoline according to claim 1, wherein the fabric-clamp back baffle is provided with a baffle, and the baffle is provided with a plurality of reinforcing ribs.

7. The trampoline according to claim 6, wherein a surface of the baffle is provided with a plurality of exhaust holes.

8. The trampoline according to claim 1, wherein the fabric-clamp upper plate is fixedly fused to the fabric-clamp lower plate and the bounce fabric by ultrasonic welding.

* * * * *